United States Patent [19]

Hughes et al.

[11] 4,122,369

[45] Oct. 24, 1978

[54] MAGNETIC DEFLECTION APPARATUS POSITIONED BEHIND TARGET

[75] Inventors: William C. Hughes; Harold G. Parks, both of Scotia, N.Y.

[73] Assignee: General Electric Company, Schenectady, N.Y.

[21] Appl. No.: 839,331

[22] Filed: Oct. 4, 1977

Related U.S. Application Data

[62] Division of Ser. No. 679,245, Apr. 22, 1976, Pat. No. 4,070,597.

[51] Int. Cl.[2] ..... H01J 29/72; H01J 29/80

[52] U.S. Cl. ..... 313/430; 313/431; 335/210

[58] Field of Search ..... 313/414, 431, 432, 458, 313/460, 442, 430

[56] References Cited

U.S. PATENT DOCUMENTS 3,821,582 6/1974 Hughes ..... 313/432 X

FOREIGN PATENT DOCUMENTS 1,110,718 2/1956 France ..... 313/442

834,497 5/1960 United Kingdom ..... 313/442

*Primary Examiner*—Robert Segal

*Attorney, Agent, or Firm*—Geoffrey H. Krauss; Joseph T. Cohen; Marvin Snyder

[57] ABSTRACT

An improved fine deflection, for use in an electron beam optical system, utilizes a magnetic deflector positioned adjacent to the surface of the target most remote from a matrix lens, which is positioned between the target and an electron beam emitter. The matrix lens is a single plate having multiple apertures forming matrix lenslets and has an electron beam accelerator positioned between the lens and the target for uniform acceleration of the electron beam passing through a selected one of the lenslets.

3 Claims, 6 Drawing Figures

Fig. 1
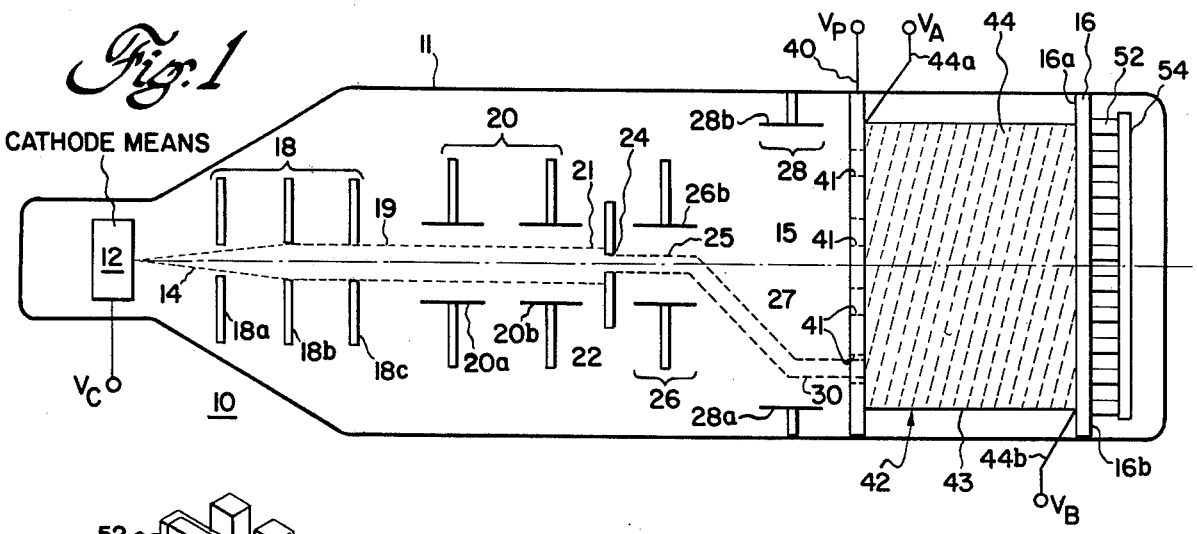
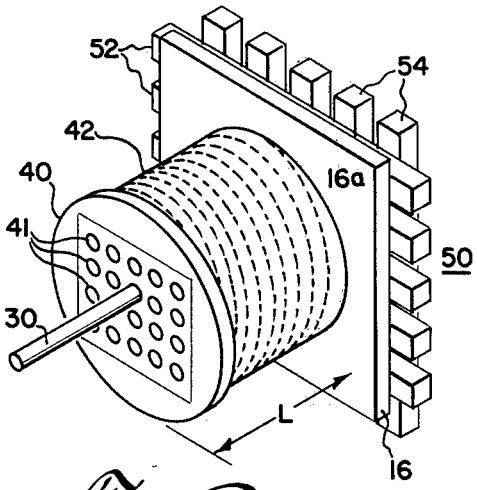
Fig. 2
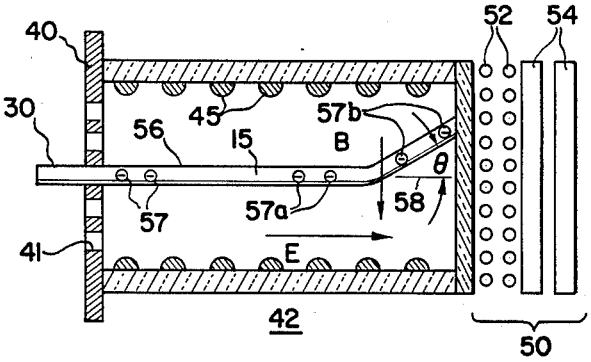
Fig. 2a
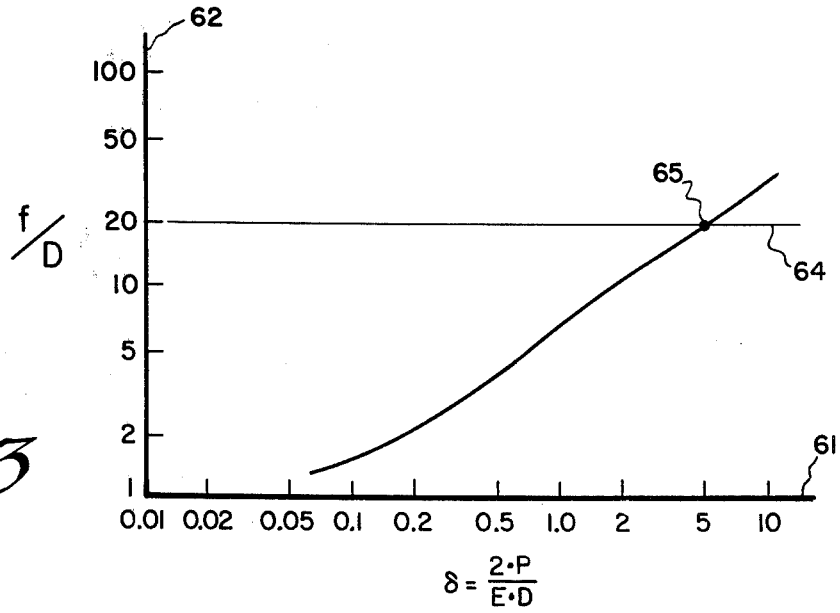
Fig. 3

MAGNETIC DEFLECTION APPARATUS POSITIONED BEHIND TARGET

This is a division, of application Ser. No. 679,245, filed Apr. 22, 1976, now U.S. Pat. No. 4,070,597 of Jan. 24, 1978.

BACKGROUND OF THE INVENTION

The present invention relates to novel electron beam apparatus and methods for controlling the point upon a target surface at which an electron beam will impinge and, more particularly, to a matrix lens and fine deflection system for determining the sharpness of focus and the exact impingement position of the "spot" of an electron beam on a target in an electron beam focussing and positioning system.

Modern data processing requires high capacity, random access memory of extremely high bit storage density, which memory must permit rapid data storage and retrieval. One advantageous memory device utilizes an electron beam focussing and positioning system of the type having a coarse deflection system for causing the electron beam source to be presented to a selected one of a plurality of electron lenses arranged in the form of a two dimensional matrix, with a second, or fine, deflection assembly for focussing the beam passing through each single lenslet on a desired specific point of a target structure. A system of this type is disclosed in U.S. Pat. No. 3,534,219, issued Oct. 13, 1970 to S. P. Newberry, the entire disclosure thereof being incorporated herein by reference. Additionally, the extremely fine (substantially microscopic) spot size and the rapid repositioning ability of such an electron beam deflection system can be utilized for conventional purposes for which cathode ray tubes have long been used and, furthermore, for such diverse processes as welding, etching photomicrographs for the production of high density integrated circuits and the like.

The dual-stage (coarse and fine deflection) electron beam control system is particularly advantageous in that the electron beam is finely focussed upon any precisely controlled point upon a relatively large surface area target with the finely focussed beam being movable between any two points thereon in highly precise manner and in an extremely short time.

STATE OF THE ART

The "Cascaded Electron Optical System" of the aforementioned U.S. Pat. No. 3,534,219 describes, briefly, an electron optical system of the "fly's eye lens" type, which is so named because of its similarity in general arrangement to the compound eye of the common house fly. In this system an electron beam is initially collimated and is then coarsely deflected to any one of a plurality of fine apertures or lenslets acting as the fine focussing means of a final, fine deflection subsystem, which additionally includes fine deflecting means for causing the focussed beam to impinge upon the specifically selected, precise point on the target. Actually, the Newberry system is somewhat more complex than this and, as may best be seen in FIG. 1 of the Newberry patent, there is a coarse deflection assembly comprising plates 21, 23, 25 and 27 for initially deflecting the beam, and a set of respective horizontal and vertical deflection bars 31 and 32, respectively, for redeflecting the initially-deflected electron beam to be parallel to its original direction, i.e., the axis of the system. The electron beam is caused to go through one of the apertures of condenser lenses 35 to be initially deflected by a first set of intermediate vertical and horizontal deflection bars 36, 40, respectively, and subsequently by a second set of intermediate vertical and horizontal bars 46, 43, respectively, whereby the beam passes through one of a plurality of apertures in the fly's eye lens 50. Each of the fly's eye lenses are shown without detail in the aforementioned FIG. 1, with the general arrangement of a plurality of fly's eye lenses being seen in FIG. 3 of the patent. In specific detail, shown in FIG. 4 of the Newberry patent, each of the individual apertures 60 in each fly's eye lens 50 is illustrated along with the fine final vertical deflection bars 55 and the fine final horizontal deflection bar 58. In FIG. 6 thereof, the lens action in each of the apertures 60 is shown as being caused by utilizing three separate plates 61, 66 and 70, each of which have aligned apertures and are provided with appropriate voltages whereby each aperture set acts as an electrostatic lens. Similar three-plate lenses are utilized as an intermediate condenser 35 and as a first electron beam condensing lens 20 with each of these condensers being of the Einzel type, i.e. a three plate arrangement wherein the outside plates have the same voltage (often being at ground potential) and the middle plate has a different potential imposed thereon.

The dimensions of each individual aperture 60 in each lens 50 are extremely small whereby alignment of the three plates is an extremely difficult task. It was extremely desirable to replace the three-plate Einzel lens with a device facilitating avoidance of the undesirable asymmetrical electrostatic effects on a beam passing through the apertures in all the lenses, due to the lack of ultraprecise alignment of the plates. The three-element Einzel lens is replaceable with a two-aperture immersion lens, as fully disclosed in U.S. Pat. No. 3,936,693 issued Feb. 3, 1976 to the present applicants, and fully incorporated herein by reference. The substitution of a two-aperture immersion lens (for the three-element Einzel lens) facilitates more accurate alignment but also enables optical advantages by: lessening the value of spherical aberration; allowing higher electron beam current densities and lowering the voltage requirements for the coarse beam deflection system. However, the two-aperture immersion lens still requires a certain amount of precision alignment between the two aperture plates 48 and the orthogonally-oriented fine deflection structures 49 which must be positioned between the pair of aperture plates and the target 50. It is desirable to eliminate even this lessened alignment requirement whereby a series of extremely small apertures in one plate must relate to a similar series of apertures in a second plate. Further decrease in the spherical aberration of the spherical aberration and of the deflection voltage requirements of the system are also desirable.

Further, an additional practical difficulty involved in the Newberry system, and more particularly in fabricating his device, is that the fine wire deflection bars 55-58 (see FIG. 4 of Newberry) must, of necessity, have a width no wider than the spacing between adjacent edges of aperture 60 therein, and, in practical terms, the bars must have an effective diameter of no more than 30 milli-inches. Concurrently, each of the deflection bars must be precisely made so that the effective diameter or width thereof does not vary to an appreciable extent, as the effect of the bars on the electron beam may vary for the same deflection voltage dependent upon which of apertures 60 is actually utilized. It is desirable to avoid this problem of precision in the fine deflecting means by utilizing a different system for vertical and horizontal fine deflection, which system is not emplaced between the lenslets and the target.

BRIEF SUMMARY OF THE INVENTION

In accordance with the invention, an improved matrix lens for use in electron beam optical system of the type having first means for forming a narrow electron beam; coarse deflection means associated with the first means for scanning the electron beam to each lenslet of a matrix array of individual lenslets; and fine deflection means cooperating with the matrix lens array for focussing the beam upon a specific selected site of a target surface, utilizes a lens comprising a single plate having a plurality of apertures arranged in a two dimensional array and a single accelerator means positioned between the single plate lens and the target for uniformly accelerating the beam passing through any of the lens apertures. The use of a single apertured plate completely removes the precision alignment requirements associated with the Einzel lens system of Newberry and with our prior two-lens immersion system while realizing a decreased value of spherical aberration and an increased deflection sensitivity for the beam.

In a preferred embodiment of the present invention, the accelerator means, which is of the type not requiring exact alignment with each individual aperture of the single plate, is the only element between the plate and the target, with the final fine deflection means utilizing a magnetic deflector positioned upon the side of the target remote from the improved flies eye lens. The "under-the-target" magnetic (UTM) deflector provides a vertical and horizontal fine deflecting magnetic field which interacts with the beam electrons in a uniform manner, whereby the deflection sensitivity is essentially the same for a beam passing through any of the single plate apertures to essentially remove the problem caused by the lack of precision in the formation of the deflection bars utilized in the Newberry system.

Thus, the present invention may be broadly characterized as replacing the structure shown as element 60-70 in FIG. 6 of the Newberry patent with an entirely different type of fine focussing lens assembly, namely, a single lens plate having an array of apertures and a single accelerator means which operates in conjunction with each and every one of the plurality of apertures to eliminate any alignment problem as well as providing specific optical advantages as will appear more specifically hereinbelow. Additionally, the present invention also replaces the fine deflection structure comprised of thin bars 55-58, shown in FIG. 4 of Newberry with a deflection system which does not require extremely precisely formed and precisely positioned bars, i.e. by utilizing a magnetic deflector positioned on the opposite side of the target from the fly's eye lens. Although the Newberry patent has been utilized for purposes of explaining the type of environment in which the present invention would typically be used, it is obvious that none of the details of the Newberry patent are necessary for the operation of the presently disclosed device and, in fact, the invention as hereinafter described in detail will be considered as merely being used in the general type of environment that is provided, for example, by the Newberry patent.

Accordingly, it is one object of the present invention to provide a novel electronic lens of the type having a single plate in which is formed an array of apertures through which an electron beam selectively passes.

It is another object of the present invention to provide a novel electronic lens for focusing an electron beam upon a target structure, and requiring mimimum alignment therewith.

It is another object of the present invention to provide a novel single-plate matrix lens having reduced spherical aberration as compared with prior art lenses having a plurality of plates.

It is a further object of the present invention to provide novel fine deflection means for uniformly deflecting an electron beam passing through any one of a multiplicity of small, closely-spaced apertures in a lens.

A still further object of the present invention is to provide novel fine deflection means positioned outside of the volume defined between an electronic lens and the target structure with which it operates.

A still further object of the present invention is to provide novel methods for finely focussing an electron beam upon a selected site on the surface of a target.

These and other objects of the present invention will become clear to those skilled in the art upon reading the following detailed description and the accompanying drawings.

BRIEF DESCRIPTION OF THE DRAWINGS

FIG.1 is a simplified schematic view of an entire electronic storage tube in which a single-plate lens and an under-the-target deflection means are utilized;

FIG. 2 is a perspective view of a portion of FIG. 1, showing a single-plate lens, an accelerator means, the storage target and one preferred embodiment of an under-the-target fine magnetic deflection means in accordance with the principles of the invention;

Figure 4:
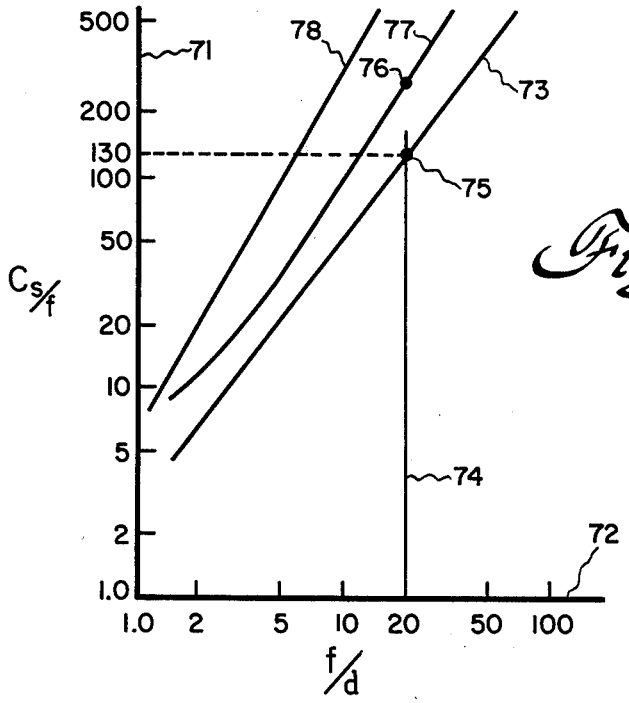
Figure 5:
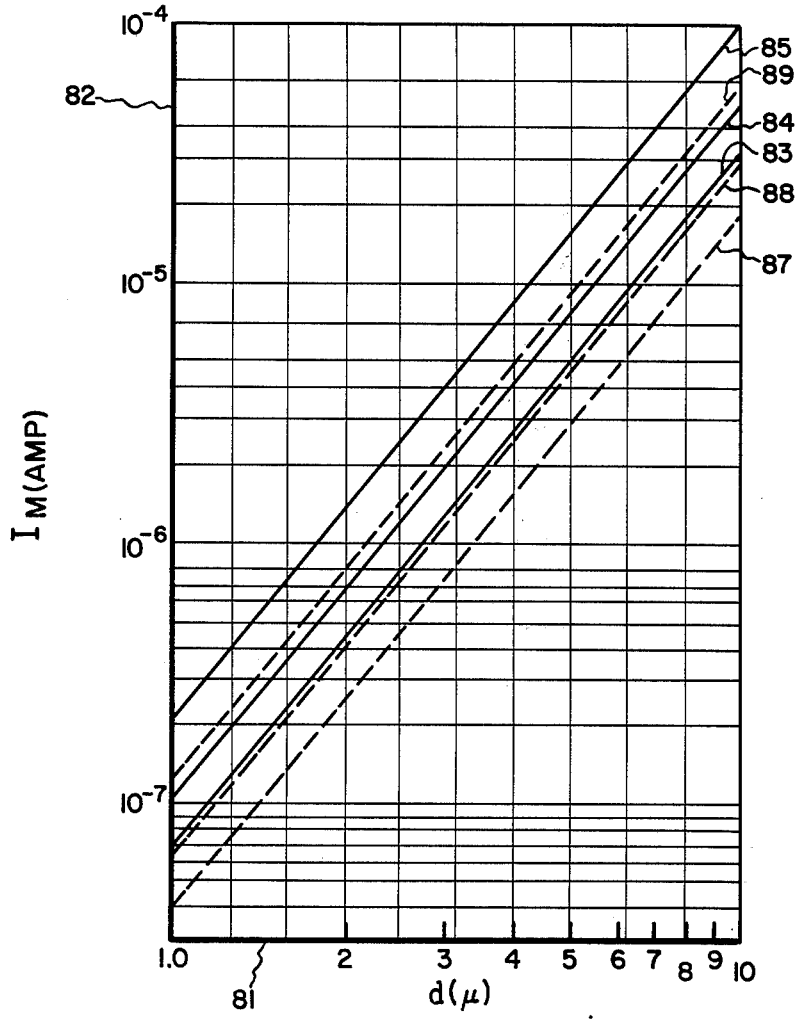

FIG. *2a* is a sectional view taken along lines *2a-2a* and illustrating the acceleration and deflection of the electron beam;

FIG. 3 is a graph illustrating the relationship between the strength factor $\delta$ and the normalized focal length;

FIG. 4 is a graph illustrating the relationship between normalized values of spherical aberration constant $C_s$ and normalized focal length for the respective single plate; two-aperture immersion and three-plate Einzel lenses and showing the reduction in spherical aberration achieved by the present invention; and FIG. 5 is a graph illustrating the relationship between focussed spot size and maximum beam current obtainable for several values of electron gun cathode emission for the single-plate lens of the present invention in comparison with the two-plated immersion lens of our aforementioned prior patent.

DETAILED DESCRIPTION OF THE INVENTION

Referring initially to FIGS. 1, 2 and *2a*, an electronic storage tube 10 comprises an evacuated envelope 11 containing cathode means 12 positioned at one end thereof, for emitting a beam 14 of electrons along the axis 15 of the tube towards the opposite end thereof. Beam 14 is to be focussed as a small spot impinging upon a selected small and precise area of the left-hand surface of a target 16 positioned at the opposite end of tube 10. Although target 16 may be an element which is intended to be physically altered by the focussed electronic beam, for purposes such as welding, etching or the like, it is assumed herein that the target is actually a semiconductor device comprising one or more layers of dielectric material, semiconductor material and, typically, a conducting electrode layer. Such a semiconductor target forms a "memory" in which a focussed electron beam can write a bit of data by causing local disturbances in the electrical neutrality of a small area thereof. The contents of the disturbed area is subsequently read by inducing an electric current to flow through the storage medium, i.e., the dielectric material, and to an electrode. The current varies dependent upon whether the area in which the reading electron beam impinges has previously been written, i.e., electrically charged, by the beam. Thus, the entire contents of tube 10, with exception of target 16, are present for the general purpose of forming an extremely small electron beam spot which must be addressed to each individual data storage site of the target. A typical spot size is of the order of about 2 microns in diameter, whereby the storage site spacing must be of approximately the same order of magnitude and the precision of electron beam deflection must be such as to enable the spot to impinge upon the site with at least the same order of precision while providing the capability for rapidly scanning the spot between sites scattered across the entire surface 16*a* of the target.

A condenser lens 18, illustrated as comprising three apertured plates 18*a*, 18*b* and 18*c*, respectively, progressively axially arranged along tube axis 15, collimates electron beam 14 as the beam travels from cathode means 12 towards target 16. A highly collimated electron beam 19 exits from condenser means 18, which may be an Einzel lens comprising three plates 18*a*, 18*b* and 18*c*, respectively. The beam passes along tube axis 15 through accelerating means 20 comprising a plurality of annular beam steering electrodes 20*a*, 20*b*, etc., each of which electrodes is uniformly energized with increasingly greater positive electrical potentials with respect to the electrical potential $V_C$ impressed upon cathode means 12. The accelerated, collimated electron beam 21 is directed by steering plates 20*a*, 20*b* to a plate 22 having a small central aperture 24, which aperture has a diameter determining the diameter of the emerging beam 25. It should be understood that none of the various elements in FIG. 1 are drawn to scale, but are intentionally exaggerated to show the effect of each element; thus, aperture 24 is intentionally shown as being significantly smaller than the entering electron beam 21, although in practice, the diameter of beam 21 would normally be only slightly larger than aperture 24 to avoid excessive waste of cathode means emission.

Emerging electron beam 25, having a controlled diameter and divergence, is deflected from central axis 15 by a first coarse deflection assembly 26, schematically represented by a pair of spaced parallel plates 26*a*, 26*b*. Control voltages are applied to one or both of these plates in known manner. The deflected electron beam 27 is subsequently deflected back to parallelism with central axis 15 by a second coarse deflection assembly 28, schematically represented by a pair of parallel deflection plates 28*a*, 28*b* which are spaced apart a greater distance than the spacing between first coarse deflection assembly plates 26*a*, 26*b* so as to allow deflected electron beam 27 to travel a substantial distance from the central axis before it is once again deflected to become electron beam 30 again parallel to the central axis. By controlling the relative voltages on first coarse deflection assembly deflection plates 26*a*, 26*b* and on the second, or compensating, coarse deflection plates 28*a*, 28*b*, electron beam 27 is deflected to any "height" above or below central axis 15 and is subsequently redeflected substantially parallel to this axis at the chosen height therefrom. It should be understood that similar first and second coarse deflection assemblies are provided above and below the plane of the drawing, and parallel thereto, for deflecting electron beam in a direction mutually orthogonal to the illustrated deflection direction and to the surface of target 16; these additional plates, which may be considered as the horizontal coarse deflection plates of the system (with the illustrated first and second coarse deflection assemblies 26 and 28, respectively, being considered as the vertical coarse deflection plates) have been intentionally omitted from the drawing for purposes of simplicity and in view of the fact that such deflection systems are well known. Similarly, it should be understood that the beam forming system including cathode means 12, second coarse deflection assembly 28 and all elements therebetween, is only one of a variety of such systems capable of utilization with the novel single-plate matrix lens to be described and, in fact, somewhat better practical results may be obtained utilizing a relatively small diameter "deflectron" deflection assembly instead of first coarse deflection assembly 26, with a similar "deflectron" device of larger diameter replacing the second coarse deflection 28; therefore, the actual coarse beam forming and positioning means including cathode means 12, coarse deflection assemblies 26 and 28 and all electron optical means therebetween, are illustrative only and do not form a part of the present invention.

A matrix lens is an array of small electron lenses (or lenslets) which, in the Newberry scheme and our prior two-plate immersion scheme, was followed by a deflection system designed to provide each lenslet with its own deflection system. The final focussing of the electron beam on the target and the deflection of the beam over small areas of the target under each lenslet was accomplished by an individual lenslet and its individual associated deflection system. By final focussing and deflecting the beam over a small subfield with each individual lenslet in this manner, electron beam recording of information in this target was realized. The lenslet deflection system for both the three-aperture Einzel lens of Newberry and the two-aperture immersion matrix lens of our prior invention require a two-dimensional array of x-axis and y-axis deflection bars following the aligned two or three lens plates whereby each lenslet was provided with its own individual parallel-bar *x*, *y* deflection system.

The single-aperture matrix lens of the present invention comprises a single plate 40 preferably formed of a metallic material, and having a two-dimensional matrix of apertures 41 formed therethrough. Single plate 40 is positioned at a distance L from the front, or recording, surface 16*a* of target 16. Typically, there will be approximately 16 apertures per linear inch formed through the conducting plate so that a one-square inch plate, or a corresponding area of a larger plate, would contain, for example, a 16 × 16 array of apertures 41, each of which acts as a lenslet or at least as part of a small lens, in conjunction with the remaining structure described hereinbelow. Therefore, one of the main distinguishing characteristics of the device made according to the present invention is the fact that only a single plate 40 is utilized rather than a pair of plates having aligned apertures (as in 21 and 22 in FIGS. 2 and 3 of applicants' previous patent).

The coarse deflection assemblies 26 and 28 serve to illuminate one of apertures 41, dependent upon the particular deflection voltages with which plates 26*a*, 26*b* and 28*a*, 28*b* are driven. In order to provide the desired accelerating action whereby plate 40 and its apertures 41 act as a focussing means for focussing beam 30 onto target surface 16*a*, acceleration means 42 is utilized in conjunction with the single matrix plate 40. Accelerating means 42 is positioned between matrix plate 40 and target 16 and may advantageously be partially constructed of insulating material, such as glass, ceramic and the like, to space plate 40 at the desired distance L from target surface 16*a*. In a preferred embodiment, acceleration means 42 comprises a cylindrical insulator 43 having its axis lying along tube axis 15 and having a diameter sufficient to encircle the entire matrix of aperture 41 in plate 40.

In one preferred embodiment, a spiral pattern of a resistive material 44 (shown by broken lines in FIG. 1) is formed upon the interior surface of insulating cylinder 43, in a manner known in cathode ray tube technology. The accelerating spiral is energized by a potential impressed thereacross, with the voltage $V_A$, at the left-hand end 44*a* of the accelerator spiral, being substantially different from the voltage $V_B$ applied at the right-hand end 44*b* of the accelerator spiral. To provide the desired accelerating action upon the electrons of beam 30, the voltage $V_B$ close to target 16 will be substantially more positive than the voltage $V_A$ closest to the single plate 40.

In another preferred embodiment, acceleration means 42 utilizes a series of spaced rings 45 (FIG. 2*a*) also formed of an electrically conducting material, placed upon the interior surface of insulating tube 43 (whereby the dielectric material of tube 43 does not interfere with the field) with each successive ring being maintained at successively higher potentials from lens plate 42 to target 16 by means (not shown), such as a resistive divider, connected between high acceleration potential $V_B$ and low acceleration potential $V_A$. The planes of each ring 45, plate 40 and target surface 16*a* are substantially all parallel each to the others while the spacing between each ring may be uniform or may be otherwise established to facilitate the desired acceleration characteristic.

In either embodiment, the acceleration electrode closest to target 16 is insulated therefrom, whereby voltage $V_A$ may be more negative than voltage $V_B$ and both $V_B$ and the target may be held at electrical ground potential.

An individual aperture 41, to which beam 30 is directed by the first and second coarse deflecting assemblies 26 and 28, respectively, is maintained at a particular plate potential $V_P$, with respect to the potential $V_C$ of cathode means 12; the increased voltages present in accelerator means 42 cause electron beam 30 to be focussed to an extremely small area on target surface 16*a*, whereby each aperture 41 cooperates in conjunction with the accelerating field to form an electrostatic lenslet. As a single plate is utilized, the alignment of two or more plates, each contain a matrix of apertures, is eliminated and the single aperture lens is considerably easier and less costly to fabricate.

Each lenslet (partially formed by a selected one of apertures 41, which in a preferred embodiment has a diameter D of about 30 milli-inches (mils) at a distance L of about 600 mils from target surface 16*a*) is used to focus electron beam 30 over only a small portion of the target, which portion is, in the preferred embodiment, an area of approximately 60 mils square. A fine deflection means is necessary to scan beam 30 to the exact location of a spot of approximately 2 microns diameter within this 60 mil square. As the 60 mil square has a length of approximately 1500 microns per side, at least one-half million, two-micron-square sites must be distinguished between by beam 30. Fine deflection means sufficiently selective to achieve the exact focussing required is, in both the Newberry patent and, implicitly, in applicants' prior patent, formed of the aforementioned *x, y* array of deflection bars positioned between the multi-plate lenslet array and the target (being shown as horizontal and vertical bars 55–58 in FIG. 4 of the Newberry patent and being merely schematically illustrated at 49 in applicants' previous patent). In the present device, the fine deflection means cannot be placed between target 16 and the final fine focussing means as the electrostatic field of an orthogonal-bar deflection means and of accelerator means 42 would adversely affect each other. Therefore, fine deflection means 50 is positioned adjacent to the side 16*b* of the target most remote from lensplate 40 and accelerator means 42. This position serves to maintain the overall diameter of tube 10, although, if overall diameter is not crucial, fine deflection means 50 could be of an annular shape, fitting and spaced from the exterior of accelerating means 42.

As best seen in FIG. 2, fine deflection means 50 comprises a series of spaced parallel horizontal bars 52 and a series of spaced parallel vertical bars 54 orthogonal thereto, all of the bars being formed of a conducting, and preferably metallic, material with means (not shown for purposes of simplicity) being provided for supplying a first set of essentially equal currents to each individual one of horizontal bars 52 and a second set of essentially equal but usually differing currents, to each of vertical bars 54. Current flow through the orthogonal array of horizontal and vertical current conductors 52 and 54, respectively, establishes a magnetic field B (FIG. 2*a*) within the volume of accelerator means 42 and in a plane substantially transverse to both the tube axis 15 and the axis of the electron beam passing through one of apertures 41. Magnetic field B is of essentially uniform magnitude across the entire plane cutting tansversely through tube 43, whereby the magnetic field reacts in uniform fashion with the electron beam passing through any aperture in plate 40. Thus, the UTM fine deflection means serves all lenslets in common and, as deflection means 50 is located under the target, the requirement for precision alignment with lens plate 40 is not as stringent as in the previous Newberry system. This magnetic fine deflection system facilitates even greater simplification of construction (with the corresponding reduction in cost) as precisely machined deflection bars do not have to be aligned with each individual lenslet, but allows a magnetic field forming means to be more generally aligned with the plane of single aperture plate 40. It should be understood that the orthogonal array of current conductors illustrated in FIGS. 2 and 2*a* represent one approach to forming a uniform magnitude magnetic field B within the volume of accelerator means 42; other means are equally adaptable, such as the use of a single conductor carrying a relatively high magnitude of sheet current to form the planar equimagnetic field.

In operation, beam 30 (FIG. 2*a*) passes through a selected one of apertures 41 in a single lens plate 40, as selected by the potentials applied to the various plates of first and second coarse deflection assemblies 26 and 28, respectively, to emerge as a somewhat constricted electron beam 56 due to the electrostatic "lens" action of charged plate 40. The beam has a relatively low energy, as indicated by the relatively close spacing of beam electrons 57, adjacent to the surface of lens plate 40 closest to target 16. Electrons 57 are acted upon by acceleration electric field E formed by accelerator coil means 44 or 45 (positioned upon the exterior surface of cylindrical insulator 43,) whereby electrons 57 are made to possess greater energy, as indicated by the progressively greater spacing between electrons 57*a* and between electrons 57*b* as beam 56 approaches target 16. The net effect of the electrostatic constriction and acceleration is a convergent lens effect upon the beam, whereby beam 56 impinges upon a narrow spot defined on target surface 16*a*.

Simultaneous with the above-described fine spot focussing action, a flow of current through all of horizontal and vertical conductors 52 and 54, respectively, each conductor herein illustrated as being a multiple layer arrangement, produces magnetic field B in the plane orthogonal to the direction of travel of beam 56. A corresponding inducement of force on electrons 57*b* causes curvature of the electron beam 56 and subsequent impingement thereof upon a target site respectively vertically and horizontally displaced from lenslet centerline 58. It should be understood that beam deflection is shown only in the vertical direction for energization of coils 54, with an associated deflection component in the horizontal direction (into or out of the plane of the drawing) being enabled by suitable current flow in direction through remaining conductors 52. It should be further understood that the deflection angle $\theta$ is highly exaggerated in FIG. 2*a* for purposes of illustration; the maximum deflection angle for beam 56 emerging from any one of apertures 41 in single plate 40 is determined by the plate-to-target distance L and the maximum scanning area to be achieved (i.e. $\theta$ at most equals the arctangent of one-half the scanned area maximum dimension divided by length L.)

As can be readily appreciated, a beam passing through any one of apertures 41 encounters essentially the same magnitude of magnetic flux B and is deflected by the same angle $\theta$ for that flux, regardless of which aperture 41 the beam passes through.

A preferred design for one specific single-aperture matrix lens will now be considered to further illustrate the design and advantages thereof. The system utilizes the above-mentioned cathode means 12, condenser means 18, steering means 20 and coarse deflection assembly consisting of aperture plate 22, first coarse deflection means 26 and second coarse deflection means 28 to dually deflect the beam of electrons to the desired lenslet whereby the electrons orthogonally enter the lenslet along its axis 58. A final focussing of the electron beam over a small subfield of the target is then performed by the single aperture lens in conjunction with the UTM deflection means 50.

FIG. 3 graphically illustrates the relationship between a lens strength factor $\delta$, where $\delta = 2P/(ED)$, where P is the potential $V_P$ at the lens plate with respect to the potential $V_C$ at the cathode, E is the electric field strength between the lens and the target (FIG. 2*a*) and D is the lenslet diameter. The graph is plotted for increasing values of $\delta$ along logarithmically scaled abscissa 61. Ordinate 62 is logarithmically scaled for increasing ratios of focal length $f$ to lenslet diameter D. Field strength E may be expressed in terms of landing potential $V_L$, i.e. the potential possessed by an electron at its impingement upon target 16, with E being approximately equal to $(V_L - P)/f$.

Initially establishing the landing potential $V_L$ as having a magnitude of 10kV., with the length L separating target 16 from plate 40 as being 600 mils, and a lenslet diameter D of 30 mils, and further assuming that the focal length $f$ is approximately equal to the plate-target separation distance L, we use a ratio $f/D$ = 600 mils/30 mils = 20. Utilizing the relationship graphed in FIG. 3, we have found that for the above-calculated value of $f/D$ (plotted as line 64) of 20, we require a strength factor $\delta$ (located at point 65) of 4.5. The potential of lens plate 40 with respect to cathode means 12 is then calculated as being approximately 1000 volts, i.e. $(V_P - V_C)$ approximately equal 1kV. Thus, the anode potential of the electron gun between cathode means 12 and lens plate 40 is held at approximately 1kV., neglecting coarse deflection potentials; the coarse deflection, therefore, acts as a source of a 1000 eV. beam of electrons, whereas the two-aperture immersion lens of our prior patent requires a 4,400 eV. beam. As the required deflection drive is directly proportional to the beam voltage, the improved deflection factor $\eta$, i.e. the fraction of the two-aperture immersion lens deflection voltage required for the same deflection in the present single-aperture lens, is equal to the ratio of the respective beam energies, $\eta$ = 1000 eV./4400 eV. = 0.22. Thus, the singe-aperture lens requires less than one-quarter of the deflection potential required by our previous two-aperture lens. The reduced deflection drive requirement is a first advantage, particularly if the deflection drivers are of solid state design, which design typically has deflection voltage swings less than those of more complex, bulky and less reliable tube amplifiers, whereby reduction of the deflection drive requirements results in a more reliable and less costly deflection system.

Referring now to FIG. 4, a lens spherical aberration constant $C_S$ is normalized to focal length $f$ with increasing values being logarithmically plotted along ordinate 71, while the ratio of focal length $f$ normalized with respect to the diameter D of each lens aperture 41 is logarithmically plotted for increasing values along abscissa 72. The resulting curve 73 for the single-plate lens is entered for the $f/D$ = 20 ratio, as found hereinabove, along line 74 to yield a value $C_S/f$ = 130 at point 75. Assuming $f$ = 0.6 inches as hereinabove mentioned, the value of spherical aberration curve $C_S$ is 78 inches for the single-plate lens. By way of comparison, the coefficient of spherical aberration $C_S'$ for a two-aperture accelerating immersion lens is approximately 165 inches (as shown by a point 76 along the two-aperture curve 77) and that of $C_S''$, for the Einzel lens characterized by curve 78, is greater than 600 inches. Therefore, the single-plate lens of the present invention yields a reduction of spherical aberration by at least a factor of 2 with respect to the multiple plate lenses known in the prior art.

The effects of reduced spherical aberration are even more dramatically emphasized if beam current capability is considered. The maximum beam current $I_M$ in a spot of diameter $d$ on target surface 16*a* at a given beam brightness $\beta_i$ for a lenslet having a spherical aberration constant $C_S$ is given by the formula:

$$I_M = (k_1 d)^{8/3} (\beta_i / C_S)^{2/3}$$

and, assuming that an optimum half angle of convergence, $\alpha$, of the beam at target 16 is given by the formula:

$$\alpha = (k_2 d / C_S)^{1/3}$$

where the quantities $k_1$ and $k_2$ vary with the proportion of the total beam current falling within the target spot of diameter $d$. For a spot having 90% of the beam current falling therein, $k_1$ and $k_2$ are constants having respective values of 1.3 and 0.9. In terms of the Langmuir limit, the maximal theoretical brightness of an image, i.e. the spot focussed on target surface 16a by a lenslet 41 acting upon an object source on the opposite side thereof from target 16, is given in quantities of amperes per square centimeter per steradian, by the formula:

$$\beta_T \approx j_o(11{,}600\ V_L)/\pi T$$

where $j_o$ is the cathode loading in amperes per square centimeter; T is the cathode temperature in degrees Kelvin; and $V_L$ is the landing potential in volts, as previously mentioned hereinabove. Practical electron guns cannot fully realize the theoretical value of brightness and a more accurate and practical representation is given by $$\beta_i = \gamma\beta_T$$

where $\gamma$ is the gun efficiency of a practical electron gun with respect to a theoretically perfect electron gun. Utilizing a barium dispenser cathode for cathode means 12, the cathode efficiency, $\gamma$, can be as high as 80% with electron gun parameters $j_o$, T and $\beta_i$ being summarized in the following table:

| ELECTRON GUN PARAMETERS | | | | |
|---|---|---|---|---|
| $j_o$(amp/cm$^2$) | T(° C) | T(° K) | $\beta_i$(amp/cm$^2$/sr) | |
| 3 | 1080 | 1353 | 8.2 | $\gamma V_L$ |
| 5 | 1120 | 1393 | 13.4 | $\gamma V_L$ |
| 10 | 1190 | 1463 | 25.0 | $\gamma V_L$ |

FIG. 5 is a graph illustrating the relationship between spot size $d$, in microns ($\mu$), plotted for increasing spot size along logarithmically scaled abscissa 81 with respect to the maximum beam current $I_M$, in amperes, plotted for increasing values along logarithmically scaled ordinate 82 for a single-aperture lens of the present invention being a spherical aberration constant $C_S$ of 78 inches, a gun efficiency $\delta$ of 0.8, and a landing potential of 10 kV. for three values of cathode loading $j_o$: three amp/cm$^2$ (curve 83); 5 amp/cm$^2$ (curve 84); and 10 amp/cm$^2$ (curve 85), as compared with a two-aperture lens having a spherical aberration constant $C_S$ of 165 inches for the same values of $\gamma V_L$ and $j_o$ (curve 87, 3 amp cm$^2$; curve 88, 5 amp/cm$^2$ and curve 89, 10 amp/cm$^2$). As is apparent, a cathode having a loading of three A/cm$^2$ with a single aperture lens provides slightly better performance in terms of maximum current for a given spot diameter with respect to a two-aperature immersion accelerating lens utilizing 5 A/cm$^2$ cathode loading. This result is especially important in that it is known that cathode life approximately doubles for every 50° C. reduction in cathode temperature. Referring again to the above table, it is noted that reducing the cathode loading from a value of 5 amp/cm$^2$ to a value of 3 amp/cm$^2$ (which is possible for the same spot size with the novel single-aperture lens of the present invention) a corresponding temperature decrease of 40° C. is realized. The temperature decrease represents an increase of approximately two times in terms of the MTBF of the electron gun. This increase is even more dramatic if the cathode is treated with osmium or iridium, which coating only improves performance for cathode loading less than or equal to three amperes per squre centimeter (a value now achievable as shown hereinabove). Treated cathodes have lifetimes well in excess of 20,000 hours. Thus, the life of the electron gun can be increased on the order of one decade of magnitude by the almost doubling of life associated with the reduced beam current required for the single-plate lens system disclosed herein and by the availability of osmium or iridium treatment for the cathodes at the reduced loading levels made possible by the novel lens.

In summation, there has been described a single-aperture matrix lens advantageously having less than one-half the spherical aberration of an equivalent two-aperture immersion lens; having approximately one-fourth the deflection voltage requirements as compared to the two-aperture immersion lens; and requiring only a single plate which simplifies mechanical construction and allows minimization of the required precision for alignment of the matrix lens and the target. Additionally, a magnetic deflection scheme is disclosed to provide the fine deflection system required by a single-plate matrix lens having an acceleration means positioned in the volume between the lens and the associated target, with the magnetic fine deflection means being positioned on the opposite side of the target from the lens and facilitating the elimination of a plurality of matrix lens electrostatic deflection bars, as required for use with the two-aperture immersion lens, which even further simplifies construction and removes another set of elements requiring highly precise mechanical alignment.

While the present invention has been described with reference to several preferred embodiments thereof, many variations and modifications well know be apparent to those skilled in the art. We do not desire, therefore, to be limited by the specific disclosure herein, but only by the scope of the appending claims.

The subject matter which we claim as novel and desire to secure by Letters Patent of the United States is the defined as:

1. In an electron beam optical system of the type having an electron gun means for focussing a collimated electron beam upon one of a plurality of lenslets, and a planar target spaced from the electron gun and having a surface disposed essentially transverse to the direction of travel of the electron beam prior to deflection, which target surface is to be selectably illuminated by said electron beam, and improved fine deflection apparatus comprising:

first means for producing a magnetic field parallel to said target surface and having an equimagnetic surface of selectively variable magnitude in a plane parallel to said target surface and disposed between said plurality of lenslets and said target surface;

second means for producing another magnetic field parallel to said target surface and having an equimagnetic surface of magnitude selectively variable independent of the magnitude of the equimagnetic surface produced by said first means, the selectively variable field of said second means being produced in said plane; said first and second magnetic fields being substantially perpendicular to each other and to a normal to said target surface; said first and second means both being positioned entirely beyond the plane of said target surface with respect to said electron gun means and said plurality of lenslets.

2. An improved magnetic fine deflection system as set forth in claim 1, wherein at least one of said first and second means comprises conductive means for forming an equipotential magnetic sheet in said plane and having a magnitude variably dependent upon the magnitude of a flow of current through said conductor means.

3. An improved magnetic fine deflection system as set forth in claim 1, wherein at least one of said first and second means comprises a plurality of parallel conductors arranged parallel to one another and to the plane of said target surface and forming an equipotential magnetic sheet in said magnetic field plane, said magnetic sheet having a magnitude variably dependent upon the magnitude of essentially equal flows of current through each of said plurality of conductors.

* * * * *